US010011031B2

(12) United States Patent
Hauser et al.

(10) Patent No.: US 10,011,031 B2
(45) Date of Patent: Jul. 3, 2018

(54) ONION CHOPPER

(71) Applicant: Progressive International Corporation, Kent, WA (US)

(72) Inventors: Lawrence M. Hauser, Auburn, WA (US); Sascha Kaposi, Tacoma, WA (US)

(73) Assignee: PROGRESSIVE INTERNATIONAL CORPORATION, Kent, WA (US)

( * ) Notice: Subject to any disclaimer, the term of this patent is extended or adjusted under 35 U.S.C. 154(b) by 0 days.

(21) Appl. No.: 14/613,745

(22) Filed: Feb. 4, 2015

(65) Prior Publication Data

US 2015/0217460 A1 Aug. 6, 2015

Related U.S. Application Data

(60) Provisional application No. 61/935,648, filed on Feb. 4, 2014.

(51) Int. Cl.
*B26D 3/18* (2006.01)
*B26D 3/26* (2006.01)

(52) U.S. Cl.
CPC ..... *B26D 3/185* (2013.01); *B26D 3/18* (2013.01); *B26D 3/26* (2013.01)

(58) Field of Classification Search
CPC ..... B65D 53/02; B26D 3/26; B26D 3/185; B26D 3/18; B26D 3/20; B26S 3/18; B26S 3/20; B26B 5/008
USPC ..... 99/537; 220/849, 378
See application file for complete search history.

(56) References Cited

U.S. PATENT DOCUMENTS

| | | | | |
|---|---|---|---|---|
| 1,599,346 | A * | 9/1926 | Purkey | A01C 1/005 83/425 |
| 2,720,234 | A | 10/1955 | Fett | |
| D307,532 | S | 5/1990 | Cautereels et al. | |
| 5,303,472 | A | 4/1994 | Mbanugo | |
| 5,692,424 | A | 12/1997 | Wallace | |
| 5,704,485 | A | 1/1998 | Cautereels et al. | |
| D447,019 | S | 8/2001 | Wong | |
| 6,805,032 | B2 | 10/2004 | Engdahl | |
| D499,615 | S | 12/2004 | Nordgren | |
| 7,191,691 | B2 | 3/2007 | Kaposi | |
| D546,638 | S | 7/2007 | Kaposi | |
| D548,022 | S | 8/2007 | Kaposi | |

(Continued)

FOREIGN PATENT DOCUMENTS

| | | | | |
|---|---|---|---|---|
| CA | 2028888 | A1 * | 4/1992 | |
| CA | 2440769 | A1 * | 8/2002 | B26D 1/553 |

(Continued)

OTHER PUBLICATIONS

English Translation of DE202011050041.*

*Primary Examiner* — Jennifer Swinney
(74) *Attorney, Agent, or Firm* — Lowe Graham Jones PLLC

(57) ABSTRACT

An onion chopper includes a food reservoir supporting a blade tray and having a lid attached for pivotal movement toward and away from the lid and blade tray. The lid includes at least one grid of projections configured to push through a corresponding grid of blades in the blade tray to chop the onion. A cleaning grid is provided for attachment to the grid of blades. The grid of blades forms a peripheral skirt surrounding a lower container for collecting bits of chopped onion or other foods.

19 Claims, 7 Drawing Sheets

(56) References Cited

U.S. PATENT DOCUMENTS

| | | | | |
|---|---|---|---|---|
| D548,025 | S | 8/2007 | Kaposi | |
| 7,762,169 | B2 * | 7/2010 | Kaposi | B26B 5/008 30/124 |
| 7,992,476 | B2 * | 8/2011 | Kaposi | B26B 5/008 30/124 |
| 8,087,539 | B2 * | 1/2012 | Auer | A47J 36/027 215/216 |
| 8,534,492 | B2 * | 9/2013 | Smyers | B65D 45/20 206/511 |
| 8,739,669 | B2 * | 6/2014 | Engdahl | B26D 1/553 83/404.3 |
| 2003/0178428 | A1 * | 9/2003 | Chang | B65D 53/02 220/378 |
| 2015/0345200 | A1 * | 12/2015 | Repac | E05F 1/1215 241/84.3 |

FOREIGN PATENT DOCUMENTS

| | | | | | |
|---|---|---|---|---|---|
| CH | 275733 | A | * | 6/1951 | B26D 3/26 |
| DE | 821830 | C | * | 11/1951 | B26D 3/26 |
| DE | 102009023167 | A1 | * | 12/2010 | B26D 3/185 |
| DE | 202010013110 | U1 | * | 3/2011 | B26D 3/185 |
| DE | 202011050041 | U1 | * | 7/2011 | B26D 3/185 |
| EP | 571775 | A1 | * | 12/1993 | |
| EP | 2620386 | A1 | * | 7/2013 | B65D 43/0212 |
| EP | 2682240 | A1 | * | 1/2014 | B26D 3/185 |
| WO | WO 2007148853 | A1 | * | 12/2007 | B65D 43/0218 |

* cited by examiner

ONION CHOPPER

PRIORITY CLAIM

This application claims the benefit of U.S. provisional application Ser. No. 61/935,648 filed Feb. 4, 2014; the contents of which are incorporated by reference.

FIELD OF THE INVENTION

This invention relates generally to food preparation devices, including devices for chopping or slicing onions, mushrooms, and the like.

BACKGROUND OF THE INVENTION

In preparing food, it is often desirable to prepare onions by slicing them in strips or chopping them into small pieces. Most commonly, this is done by using a knife. There are other specially-designed devices for chopping foods, including some devices having a lid having a grid of projections which pivots downward to push the onion or other food item through a grid of blades. The current devices lack certain features that can sometimes make them less desirable to use, or which can improve their functionality.

SUMMARY OF THE INVENTION

A preferred onion chopper includes a food reservoir supporting a blade tray and having a lid attached for pivotal movement toward and away from the lid and blade tray. The lid includes at least one grid of projections configured to push through a corresponding grid of blades in the blade tray to chop the onion.

In one version of the invention, the blade tray includes two or more separate grids of blades, and in one such example each separate grid of blades includes blades having different configurations. For example, one larger grid may include blades forming larger openings between blades than the relatively smaller openings formed in a smaller grid of blades. In such an example, the lid preferably includes two mating sets of projections extending downward from an inner surface of the lid.

In one example of the invention, a cleaning grid is configured with a grid of holes arranged to receive the projections from the grid (or grids) of projections in the lid. In use, the cleaning grid can be inserted onto the grid of projections so that removal of the cleaning grid likewise removes bits of chopped onion (or apple, or other food items) that might be clinging to the grid of projections.

In a preferred version, the blade tray includes an upper surface and a downwardly-depending peripheral skirt which surrounds the food reservoir on which the blade tray rests. Preferably the blade tray also includes one or more bosses or other structures to facilitate pivotal attachment of the lid to the blade tray.

In an example version of the invention, the lid likewise includes a peripheral skirt surrounding all or most of the lid, in which the skirt of the lid surrounds the skirt of the blade tray when the lid is pivoted fully downward.

One version of the invention includes a series of scallops formed around a lower edge of the skirt surrounding the blade tray. In use, the blade tray may then be removed from the food reservoir and instead be placed atop a bowl or a plate. A nonskid surface attached to the scalloped edges helps to provide a grip between the blade tray and the bowl or plate.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

A preferred onion chopper, suitable for cutting or slicing onions or other food items, is illustrated in the accompanying figures. It should be appreciated that reference to an "onion chopper" is not limited specifically for use in chopping onions, but rather includes the ability to chop other food items that are suitable for chopping with a similar device.

Figure 1:
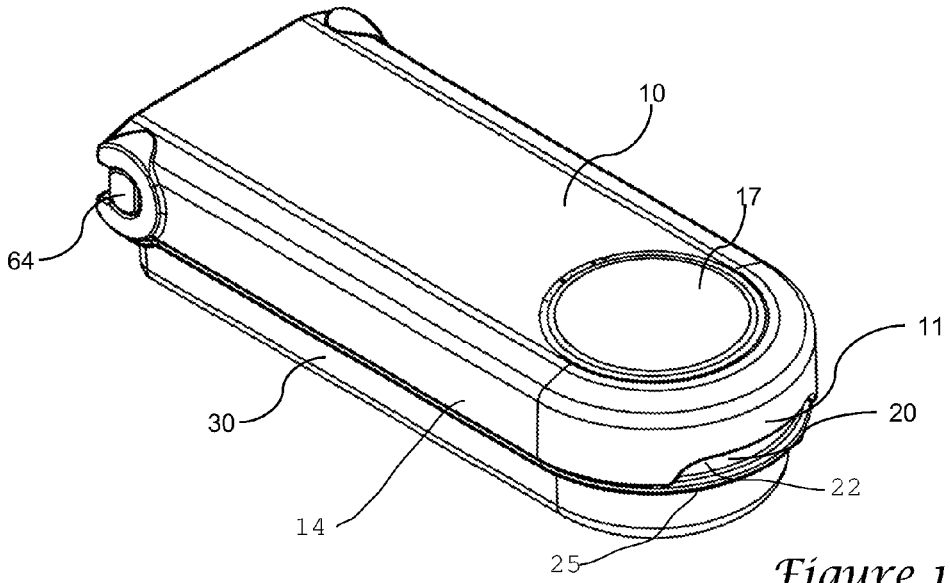
FIG. 1 is a top perspective view of a preferred onion chopper.
Figure 2:
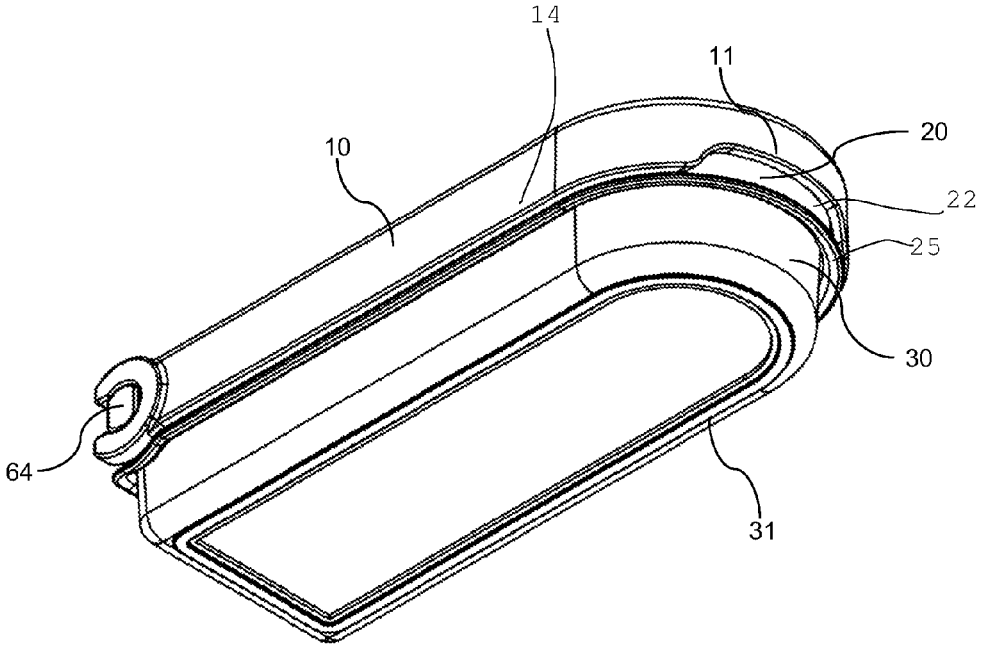
FIG. 2 is a bottom perspective view of a preferred onion chopper.

In the embodiment as illustrated, the food chopper includes three primary components, including a lid 10, a blade tray 20, and a food reservoir 30. In FIGS. 1 and 2 only a small amount of the blade tray 20 is visible beneath the lid, and in particular only a lowermost edge of the rim and a portion of the front end of the blade tray skirt, opposite the pivot location of a pair of bosses (e.g., boss 64) for attachment of the lid to the blade tray. The blade tray and the lid are pivotally connected to one another, with the blade tray being removably mounted about an upper rim of the reservoir.

Figure 3:
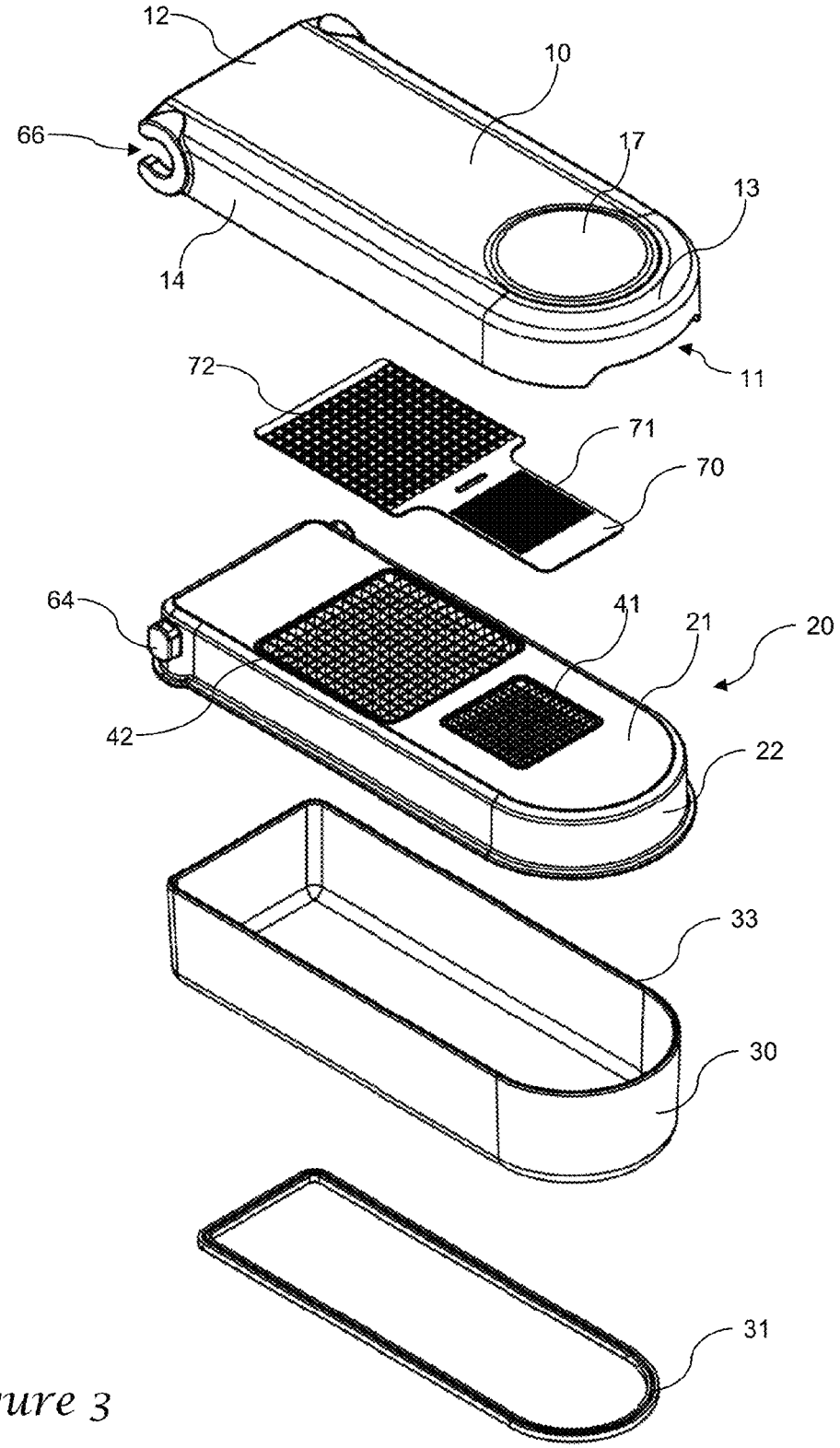
FIG. 3 is a top exploded view of a preferred onion chopper.

The lid 10 is generally rectangular in shape, having squared corners at a first end 12 that is pivotally connected to the blade tray, with rounded corners at a second end 13 opposite the first end, as best seen in FIG. 3. A downward-extending flange 14 surrounds the peripheral edge of the lid, and is sized and shaped to snugly receive an outer surface of the blade tray 20 within the flange when the lid is rotated downward against the blade tray. In the illustrated version, the flange 14 substantially surrounds three sides of the lid, and is not present between a pair of pivotal attachment locations 66, 67 formed at the first end of the lid.

In one version, the second end 13 of the lid also includes a recessed area 11 in the flange 14, providing an offset in which the height of the flange is smaller than the height of the flange on the lateral sides of the lid. As shown in FIG. 1, the lower edge of the flange on the lid extends downward to about the height of the lower edge of the blade tray skirt, which may make it difficult to pry the lid upward from the blade tray. The recessed area 11 provides an improved ability to grip the lid to pivot it upward.

Figure 4:
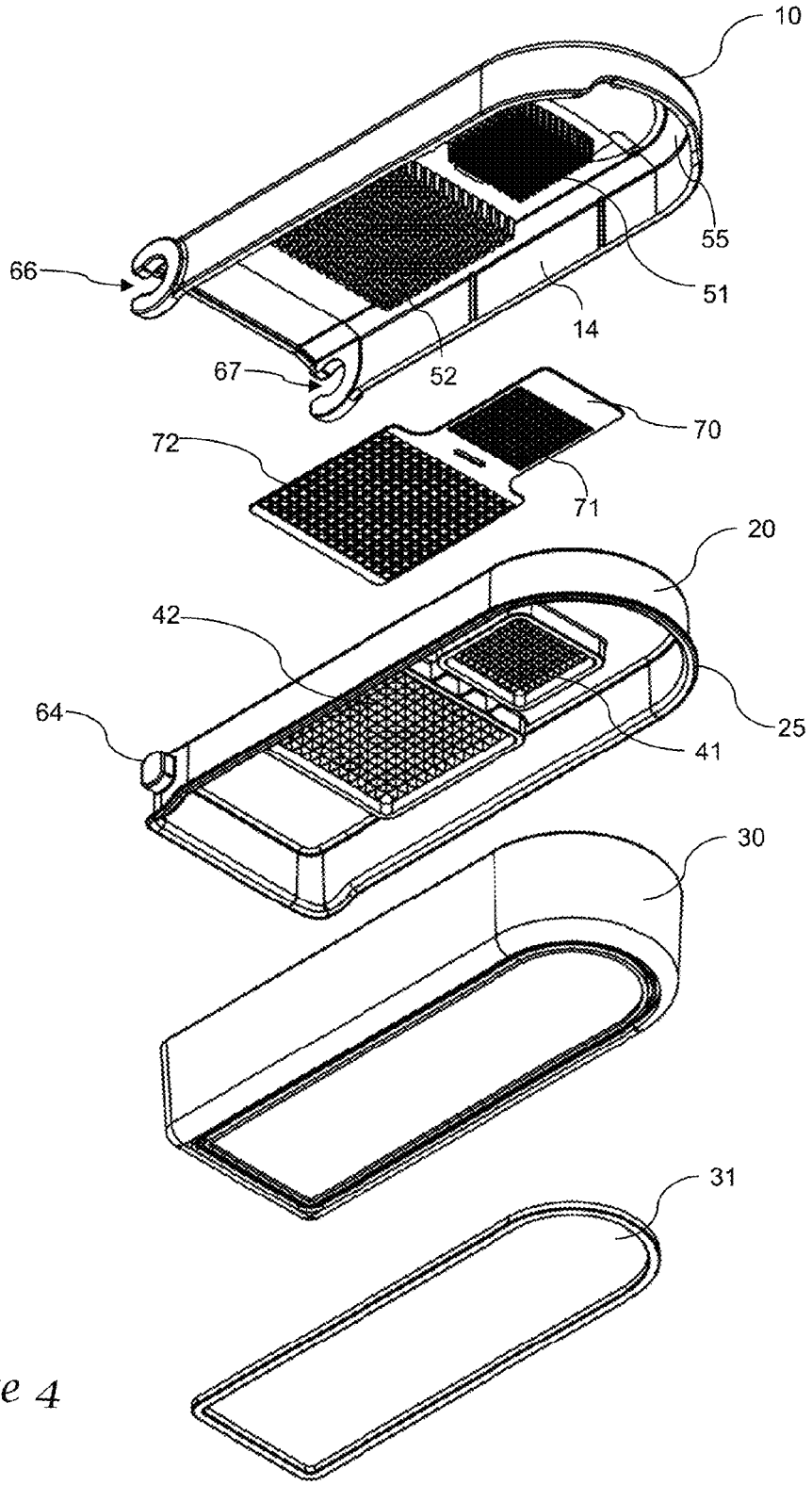
FIG. 4 is a bottom exploded view of a preferred onion chopper.
Figure 5:
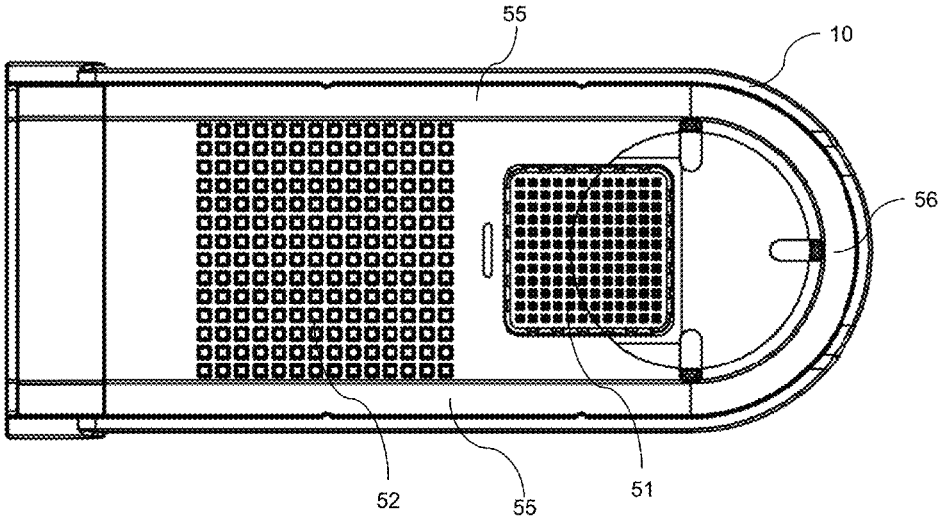
FIG. 5 is a bottom plan view of a preferred lid for use with an onion chopper.
Figure 6:
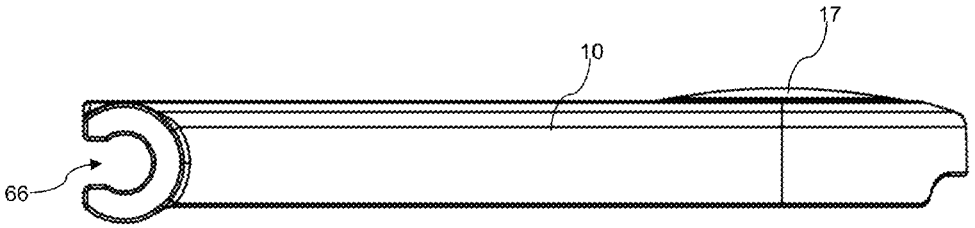
FIG. 6 is a front plan view of a preferred lid for use with an onion chopper.

The lid further includes a grid of projections on the inner surface, extending downward in the same direction as the flange, as best seen in FIGS. 4 and 5. In a preferred version of the invention the lid includes two separate grids of projections 51, 52, each spaced apart from one another. The projections may take on any size or shape, as desired, and are ideally shaped to thoroughly push the food through the blades within the blade tray. As discussed further below, the blade tray includes a network of blades configured at right angles and forming generally square openings. In the preferred version as illustrated, two separate networks of blades 41, 42 are provided, spaced apart from one another. The projections on the lid within the grids 51, 52 are sized and located within the lid such that when the lid is closed (that is, in the position as illustrated in FIGS. 1 and 2) a separate projection fits within each of the separate blade openings. Where two separate groupings of blades and projections are formed, each separate set of projections 51, 52 is configured to extend through a separate grid of blades 41, 42. Though shown as intersecting blades, in some versions the network of blades may have only parallel blades, or blades forming wedge shapes.

Preferably where two sets of blades and projections are provided the separate sets will be differently sized. In one example, a first set of blades 41 closest to the front end of the lid will have narrower gaps between blades for finer slicing, while a second set of blades 42 adjacent the pivot point will have blades spaced farther apart for coarser chopping.

The food reservoir 30 is formed in substantially the same shape as the lid and the blade tray when viewed from the top. Thus, in the preferred form, it has a generally rectangular shape with two rounded corners. The reservoir 30 includes a bottom and four side walls to form an interior rectangular cubic cavity. The depth of the reservoir may vary, and is preferably sized to hold a typical expected volume of onions, mushrooms, or other food ingredients that may be used in cooking.

The blade tray includes a pair of bosses 64, 65 at opposing sides of the squared ends of the top of the blade tray, positioned on the downwardly-depending skirt on the blade tray. The bosses are configured to be received within a pair of bores or channels 66, 67 at opposite sides of the squared ends of the tray, forming the pivotal connection between the lid and the blade tray. Accordingly, the lid is able to rotate about the pivotal connection from an open position that is preferably at least about 90 degrees with respect to the blade tray to a closed position resting adjacent and substantially flush with the blade tray.

In alternate embodiments of the invention, the reservoir also includes volumetric measurements on an inner or outer surface, which may include the bottom of the reservoir. As discussed further below, the measurements enable the user to determine when he or she has chopped enough of the food ingredient, without the necessity of a further step of transferring the ingredient to an additional measuring cup.

In one version, the bores 66, 67 on the lid are open adjacent the outer edge of the lid, forming a C-shaped channel. The C-shaped openings enable the lid to more readily be removed from the tray for cleaning.

The blade tray 20 is formed in the same shape as the lid and reservoir, such that in the preferred embodiment it comprises a rectangular shape with two rounded corners. A first substantially square blade grid 41 is formed at a first location on the tray, relatively adjacent the front end of the tray (farthest from the bosses 64), and a second substantially square blade grid 42 is formed at a second location on the tray, relatively closer to the bosses. In other versions, the blade grids may be round or have other peripheral shapes. Preferably, the tray is formed from plastic and the blade grid formed from stainless steel. The top edges of the blades within the grid are sharpened in order to slice through the foods that are being pushed through the blade grid from above.

The tray includes a flat upper surface 21 that transitions to a generally vertical peripheral wall 22 forming a peripheral skirt. The grids of blades are preferably positioned such that the sharpened top edge of the blades is within, or substantially close to, the plane defining the upper surface 21. The wall 22 is sized and configured such that the wall is snugly surrounding the outer side walls of the reservoir, with a lower surface of the tray resting on a top rim 33 of the reservoir. In this fashion, the reservoir supports the blade tray.

Each of the lid, tray, and reservoir is preferably formed from plastic, except for the blades as noted above. In a preferred form, at least the reservoir is formed from clear plastic to enable the user to see the volume of food inside.

The reservoir may optionally include non-skid feet 31 or a similar surface attached to the bottom, formed from a thermoplastic elastomer or other suitable materials. In yet other embodiments, the reservoir 30 may include a removable bottom section that is preferably friction-fitted or snap-fitted into the reservoir 30.

Figure 7:
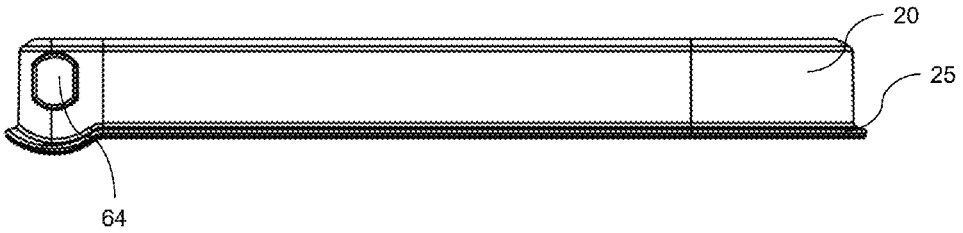
FIG. 7 is a front plan view of a preferred blade tray for use with an onion chopper.

In some versions, such as shown in FIG. 7, a lower rim 25 of the skirt surrounding the blade tray 20 may also include a non-skid material attached to the rim, such as a thermoplastic elastomer. The incorporation of a non-slip material allows the blade tray to be used when resting atop a plate, bowl, or other container other than the lower container 30. With the tray removed from the container, the chopper can be placed onto a plate, bowl, or other device with the lower rim 25 in contact with the other device to allow food to be chopped and dropped directly into the plate, bowl, or pan.

Figure 12:
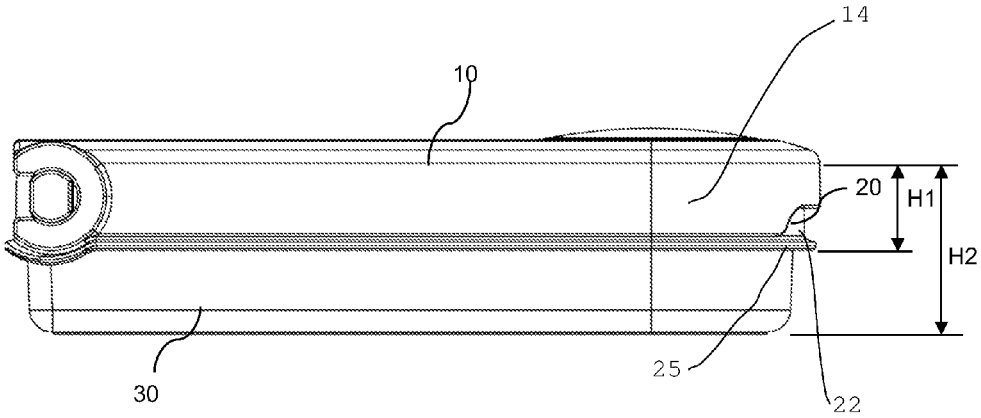
FIG. 12 is a front plan view of a preferred onion chopper.

Most preferably, as best seen in FIG. 12, the height of the skirt surrounding the blade tray (that is, the height H1 from the lower edge of the skirt to the upper surface of the blade tray) is at least half the height of the lower container (that is, the height H2), such that height H1 is at least as great as half of height H2, thereby providing a significant overlap of the blade tray skirt sidewalls and the sidewalls of the lower container. The larger overlap of the blade tray skirt with the sidewalls of the container provides an improved strength of the device overall.

Figure 8:
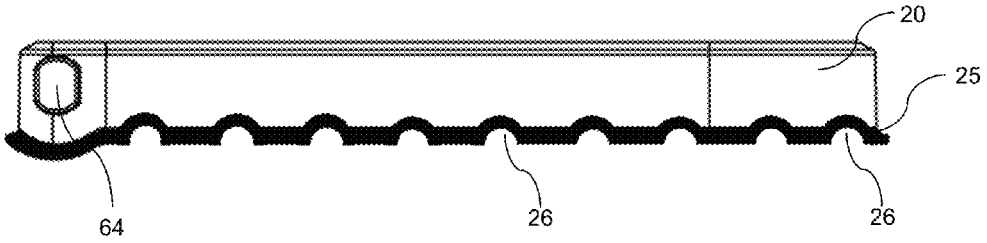
FIG. 8 is a front plan view of an alternate blade tray for use with an onion chopper.
Figure 9:
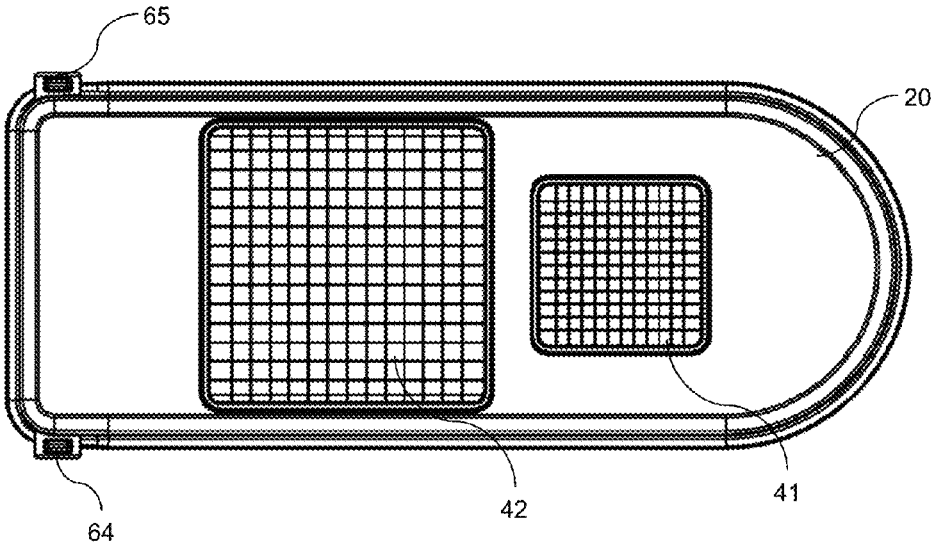
FIG. 9 is a top plan view of a blade tray for use with an onion chopper.
Figure 10:
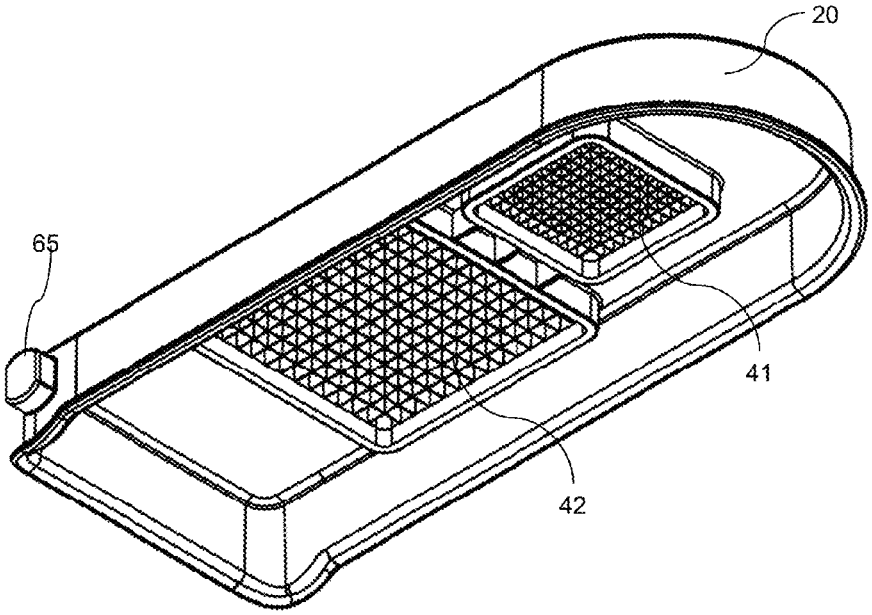
FIG. 10 is a bottom perspective view of a blade tray for use with an onion chopper.
Figure 11:
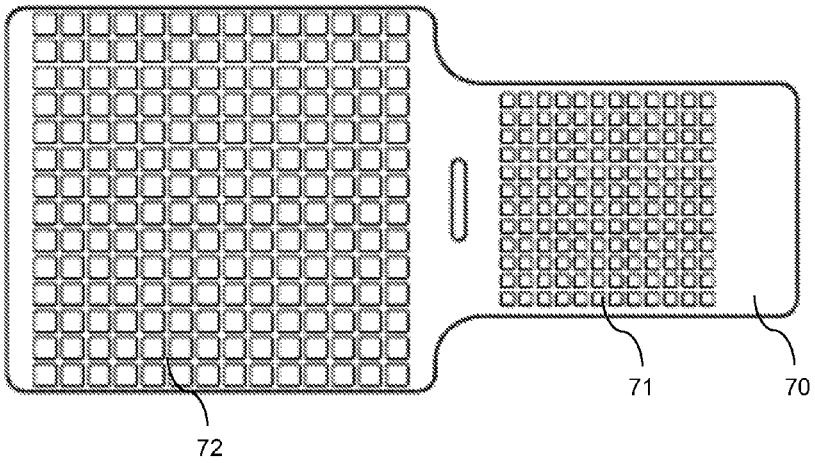
FIG. 11 is a top plan view of a preferred cleaning grid.

In some alternate versions, such as shown in FIG. 8, the lower edge of the lower rim 25 of the blade tray may also be formed with one or more raised arches, recesses, or scalloped edges 26 configured to allow the recesses to receive a rim of a bowl other than the lower container. Preferably the rim 25 is formed with a plurality of such arches extending along the lower rim in order to accommodate a bowl of varying diameters. In addition, preferably the lower rim includes a non-skid material adhered to the lower rim at the edges of the arches 26.

In some embodiments, a top surface of the lid includes a dome 17 forming a generally rounded convex shape adjacent the rounded end. This provides a better grip and more ergonomic surface for the user when chopping food within the device.

In use, the user places an onion (or other food item) atop either of the grids of blades 41, 42 while the lid is open. By pressing against the lid, causing pivotal and downward rotation of the lid, the grid of projections 51, 52 is pressed against the onion. In turn, the onion is pressed against the grid of blades, urging it through the blade openings and producing chopped onion sections having a cross-sectional shape that is the same as the blade openings. Once the lid approaches the blade grid, the projections press through the grid to clear any remaining food from the grid.

When the reservoir is full, or the chopping is completed, the tray is removed from the top of the reservoir. The chopped onion or other food may then be readily removed from the reservoir. The entire device can also be easily cleaned by separating the tray from the reservoir and, if desired, also removing the lid.

A cleaning grid 70 is provided in some versions of the invention. The cleaning grid is formed in a generally planar shape having a first grid 71 and a second grid 72, each of the first and second grids comprising a series of holes for receiving a separate one of the projections in the first and second sets of projections. The cleaning grid has an outer perimeter sized to fit within the sidewalls of the lid. The holes in the cleaning grid are sized to snugly receive the projections, such that when the grid is pressed into place or removed it closely scrapes along the projections.

In use, the cleaning grid is pressed against the projections 41, 42 such that the projections extend through the first and second grids 71, 72. Most preferably the cleaning grid is pushed upward to rest up against or close to the inner surface of the lid. As such, the lid is configured so that the projections can extend through the blade spaces with the cleaning grid in place, against the inside surface of the lid. The snug fit between the projections and the cleaning grid holes are sized so that a strong prying force is required to remove the cleaning grid. After using the food chopper to chop onions, apples, or other food items, the cleaning grid can be removed from the inside of the lid. The removal of the cleaning grid causes it to scrape along the projections, removing bits of food as the cleaning grid is removed.

In some versions, an additional layer of elastomeric material is provided along an interior of the lid 10, preferably along the inner perimeter 55 adjacent the sidewalls of the lid. The elastomeric material is positioned to abut the lower blade tray 20 when the lid is pressed downward against the tray, thereby dampening the noise. In other versions, a small bumper 55 formed from an elastomeric material is placed generally toward the distal end (that is, opposite the pivot point) on the lid or on the blade tray to provide the cushioning and noise dampening effect. In yet other versions, a similar section of elastomeric material may be attached to an upper surface of the blade tray 21.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An onion chopper, comprising:

a container having a bottom and sidewalls extending upwardly from the bottom and terminating in an upper rim;

a blade tray removably supported by the container, the blade tray having an upper surface spanning the upper rim of the container, the upper surface further having a first grid of blades, the blade tray further having a peripheral skirt which surround and extends a distance beyond the upper rim of the container and adjacent an external surface of the container when the blade tray is supported by the container, and a lid having a first end and a second end, the first end being pivotally attached to the blade tray for movement between a first position adjacent the tray and a second position in which the second end of the lid is pivoted away from the tray, the lid having a first plurality of projections sized and configured to be received within the first grid of blades when the lid is adjacent the blade tray;

the lid further having a downwardly flange extending in a vertical direction, wherein the lid is pivoted to the first position, the flange surrounds a majority of a perimeter of the peripheral skirt, the flange extends a distance beyond the upper rim, and a portion of the peripheral skirt extends below the flange.

2. The onion chopper of claim 1, further comprising a cleaning grid having a first plurality of openings sized and arranged to snugly receive the first plurality of projections, the cleaning grid being removably attached to the first plurality of projections.

3. The onion chopper of claim 1, wherein the lid comprises an outer surface and an inner surface, the inner surface being adjacent the blade tray when the lid is pivoted to the first position, the lid further having a section of elastomeric material attached to the inner surface of the lid.

4. The onion chopper of claim 3, wherein the section of elastomeric material being attached to the inner surface of the lid adjacent the sidewall.

5. The onion chopper of claim 3, wherein the blade tray further comprises a second grid of blades, the lid further having a second plurality of projections sized and configured to be received within the second grid of blades when the lid is adjacent the blade tray.

6. The onion chopper of claim 4, further comprising a cleaning grid having a first plurality of openings sized and arranged to snugly receive the first plurality of projections and a second plurality of openings sized and arranged to snugly receive the second plurality of projections, the cleaning grid being removably attachable to the first plurality of projections and the second plurality of projections.

7. The onion chopper of claim 6, wherein the container comprises a first height from the bottom of the container to the upper rim; and the the peripheral skirt of the blade tray comprises a lower rim having a lower edge, wherein when the blade tray is supported atop the container, the lower edge extends a vertical direction to the upper rim to a second height, the second height being at least half of the first height.

8. The onion chopper of claim 1, further comprising a layer of elastomeric material attached to the lower edge of the sidewall of the lid.

9. The onion chopper of claim 8, wherein the lower edge of the sidewall of the lid contains at least one scalloped region.

10. The onion chopper of claim 1, wherein the second end of the lid further comprises a recessed region, whereby a portion of the peripheral skirt of the blade tray is exposed through the recessed region.

11. The onion chopper of claim 1, wherein the blade tray further comprises a pair of bosses positioned on the downwardly extending peripheral skirt, the lid being pivotally attached to the pair of bosses.

12. An onion chopper, comprising:

a container having a bottom and upwardly extending sidewalls terminating in an upper rim to define an interior space, the container having a first height from the bottom to the upper rim;

a blade tray removably supported by the container, the blade tray having an upper surface spanning the upper rim of the container, the upper surface having a first grid of blades, the blade tray further having a peripheral skirt surrounding the upper rim of the container when the blade tray is supported the peripheral skirt spanning a vertical distance from the upper terminating at a lower edge of the peripheral skirt, the vertical distance forming a second height, the second height being at least half as great as the first height;

a lid having a first end and a second end, the first end being pivotally attached to the blade tray for movement between a first position adjacent the tray and a second position in which the second end of the lid is pivoted away from the tray, the lid having a first plurality of projections sized and configured to be received within the first grid of blades when the lid is in the first position, the lid further having a peripheral wall flange extending in a vertical direction from the lid and terminating in a lower edge, the peripheral wall flange surrounding a majority of a perimeter of the peripheral skirt of the blade tray when the lid is pivoted to the first position.

13. The onion chopper of claim 12, further comprising a section of elastomeric material positioned between the lid and the blade tray when the lid is in the first position.

14. The onion chopper of claim 13, wherein the elastomeric material is attached to the lid.

15. The onion chopper of claim 13, wherein the blade tray comprises a second grid of blades and the lid comprises a second plurality of projections, the second plurality of projections configured to be received within the second grid of blades when the lid is in the first position.

16. The onion chopper of claim 15, further comprising a layer of elastomeric material attached to the lower edge of the peripheral wall of the lid.

17. The onion chopper of claim 15, further comprising a cleaning grid having a first plurality of openings sized and arranged to snugly receive the first plurality of projections and a second plurality of openings sized and arranged to snugly receive the second plurality of projections, the cleaning grid being removably attachable to the first plurality of projections and the second plurality of projections.

18. The onion chopper of claim 12, wherein lower edge of the peripheral flange of the lid contains at least one arched region.

19. The onion chopper of claim 12, wherein the blade tray further comprises a pair of bosses positioned on the downwardly extending peripheral skirt, the lid being pivotally attached to the pair of bosses.

* * * * *